US009330865B2

(12) United States Patent
Kuruma et al.

(10) Patent No.: US 9,330,865 B2
(45) Date of Patent: May 3, 2016

(54) CURRENT SWITCH

(75) Inventors: Yosuke Kuruma, Chiyoda-ku (JP); Tsuyoshi Mori, Chiyoda-ku (JP); Masato Kawahigashi, Chiyoda-ku (JP); Yasuhiro Tsukao, Chiyoda-ku (JP); Takashi Yoshida, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/374,089

(22) PCT Filed: Mar. 23, 2012

(86) PCT No.: PCT/JP2012/057584
§ 371 (c)(1),
(2), (4) Date: Jul. 23, 2014

(87) PCT Pub. No.: WO2013/140619
PCT Pub. Date: Sep. 26, 2013

(65) Prior Publication Data
US 2015/0014278 A1 Jan. 15, 2015

(51) Int. Cl.
*H01H 33/12* (2006.01)
*H01H 1/42* (2006.01)
(Continued)

(52) U.S. Cl.
CPC ..... *H01H 33/12* (2013.01); *H01H 1/42* (2013.01); *H01H 9/443* (2013.01); *H01H 33/182* (2013.01);
(Continued)

(58) Field of Classification Search
CPC ..... H01H 9/30; H01H 9/44; H01H 31/02; H01H 31/28; H01H 33/12; H01H 33/18; H01H 33/182; H01H 31/003; H01H 1/42
USPC ..... 218/14, 19, 21, 27, 23, 20; 200/254, 200/273; 335/201, 92, 38, 207
See application file for complete search history.

(56) References Cited

U.S. PATENT DOCUMENTS 4,786,770 A 11/1988 Hamano et al.
4,803,319 A 2/1989 Bernard et al.
(Continued)

FOREIGN PATENT DOCUMENTS

EP 0248677 A2 12/1987
JP 52-84463 A 7/1977
(Continued)

OTHER PUBLICATIONS

Machine translation of JP2002042614 (orig. doc. published Feb. 8, 2002).*
(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

A current switch includes a blade-shaped movable contact that extends in a radial direction from a rotation center, and that reciprocates such that a free end of the movable contact draws a rotation locus, a fixed contact that includes a plurality of pairs of energizing contacts that come into and out of contact with the movable contact, a movable arcing contact that is provided on the movable contact, fixed arcing contacts that are provided on a pair of energizing contacts, and a pair of permanent magnets that are arranged within the pair of energizing contacts adjacent to the fixed arcing contacts.

19 Claims, 10 Drawing Sheets

(51) Int. Cl.

| | |
|---|---|
| ***H01H 9/44*** | (2006.01) |
| ***H01H 33/18*** | (2006.01) |
| ***H01H 33/64*** | (2006.01) |
| ***H01H 31/28*** | (2006.01) |

(52) U.S. Cl.

CPC ..... *H01H 33/64* (2013.01); *H01H 31/28* (2013.01); *H01H 2203/036* (2013.01); *H01H 2205/002* (2013.01); *H01H 2227/00* (2013.01)

(56) References Cited

U.S. PATENT DOCUMENTS

| | | | | |
|---|---|---|---|---|
| 8,263,890 | B2 | 9/2012 | Fujita et al. | |
| 8,278,577 | B2 | 10/2012 | Fujita et al. | |
| 8,575,508 | B2 | 11/2013 | Kashiwagi et al. | |
| 2010/0243415 | A1 * | 9/2010 | Fujita et al. | 200/273 |

FOREIGN PATENT DOCUMENTS

| | | | | |
|---|---|---|---|---|
| JP | 52-101476 | A | 8/1977 | |
| JP | 64-019639 | A | 1/1989 | |
| JP | 4-127920 | U | 11/1992 | |
| JP | 8-153445 | A | 6/1996 | |
| JP | 2002-042614 | A | 2/2002 | |
| JP | 2005285674 | * | 10/2005 | H01H 9/44 |
| JP | 2007-335148 | A | 12/2007 | |
| JP | 2010-073567 | A | 4/2010 | |
| JP | 4536152 | B2 | 9/2010 | |
| WO | WO 2012/081108 | A1 | 6/2012 | |

OTHER PUBLICATIONS

Machine translation of JP2007335148 (orig.doc. published Dec. 27, 2007).*

Machine translation of JP2005285674 (orig. doc. published Oct. 13, 2005).*

International Search Report (PCT/ISA/210) mailed on Jun. 26, 2012, by the Japanese Patent Office as the International Searching Authority for International Application No. PCT/JP2012/057584.

Written Opinion (PCT/ISA/237) mailed on Jun. 26, 2012, by the Japanese Patent Office as the International Searching Authority for International Application No. PCT/JP2012/057584.

Communication and Supplementary Search Report dated Oct. 23, 2015 issued in the corresponding European Patent Application No. 12871770.9 (7 pages).

First Office Action dated Oct. 28, 2015 issued in the corresponding Chinese Patent Application No. 201280071537.6 and English translation (17 pages).

* cited by examiner

CURRENT SWITCH

FIELD

The present invention relates to a current switch, and more particularly to a current switch including a blade-shaped movable contact that extends in a radial direction from a rotation center and that reciprocates such that a free end of the movable contact draws a rotation locus, and a fixed contact that comes into and out of contact with the movable contact within the rotating range of the movable contact.

BACKGROUND

For example, Patent Literature 1 discloses a current switch including a blade-shaped movable contact that is rotatably and pivotally supported and reciprocates such that the free end of the movable contact draws a rotation locus, and a fixed contact that includes an energizing member with which the movable contact comes into contact.

Further, Patent Literature 2 discloses an electrode structure of a switch, in which an auxiliary fixed electrode is arranged adjacent to the opening side of a main fixed electrode, a blade-shaped movable electrode that is capable of coming into and out of contact with the main fixed electrode is provided with a main contact portion that comes into and out of contact with the main fixed electrode at the time of switch-on, and is also provided with an auxiliary contact portion that moves away from the auxiliary fixed electrode after the main contact portion moves away from the main fixed electrode at the time of opening the switch, and a permanent magnet is arranged such that an arc that occurs between the auxiliary fixed electrode and the auxiliary contact portion at the time of opening the switch is driven and extinguished by a magnetic flux in a direction intersecting the arc.

CITATION LIST

Patent Literatures

Patent Literature 1: Japanese Patent Publication No. 4536152
Patent Literature 2: Japanese Patent Application Laid-open No. S52-84463

SUMMARY

Technical Problem

However, in the electrode structure described in Patent Literature 2 mentioned above, the auxiliary fixed electrode and the permanent magnet are arranged adjacent to the main fixed electrode as separate parts from the main fixed electrode. Therefore, there is a problem of an increase in both the number of parts and the dimensions of the switch in its entirety.

The present invention has been achieved to solve the above problems, and an object of the present invention is to provide a current switch that drives an arc by a permanent magnet, thereby making it possible to improve the current switching performance and to reduce the dimensions.

Solution to Problem

In order to solve the problem described above and achieve the object, a current switch according to the present invention includes: a blade-shaped movable contact that extends in a radial direction from a rotation center, and that reciprocates such that a free end of the movable contact draws a rotation locus; a fixed contact that comes into and out of contact with the movable contact, and that includes a plurality of pairs of energizing contacts that are opposed to each other on both sides of the movable contact with a rotation plane of the movable contact being sandwiched therebetween to be paired, and are arrayed in a direction of the rotation locus; a movable arcing contact that is provided on the movable contact; fixed arcing contacts that are provided on a pair of energizing contacts among the pairs of energizing contacts, the pair of energizing contacts being arranged closest to the movable contact in a state where the movable contact is away from the fixed contact; and a pair of permanent magnets that are arranged within the pair of energizing contacts, on which the fixed arcing contacts are provided, adjacent to the fixed arcing contacts, that are opposed to each other with the rotation plane being sandwiched therebetween to be paired, and that are arranged such that both magnetizing directions of the permanent magnets are perpendicular to the rotation plane.

Advantageous Effects of Invention

According to the present invention, an arc is driven by a permanent magnet, thereby making it possible to improve the current switching performance and to reduce the dimensions.

DESCRIPTION OF EMBODIMENTS

Exemplary embodiments of a current switch according to the present invention will be explained below in detail with reference to the accompanying drawings. The present invention is not limited to the embodiments.

First Embodiment

Figure 1:
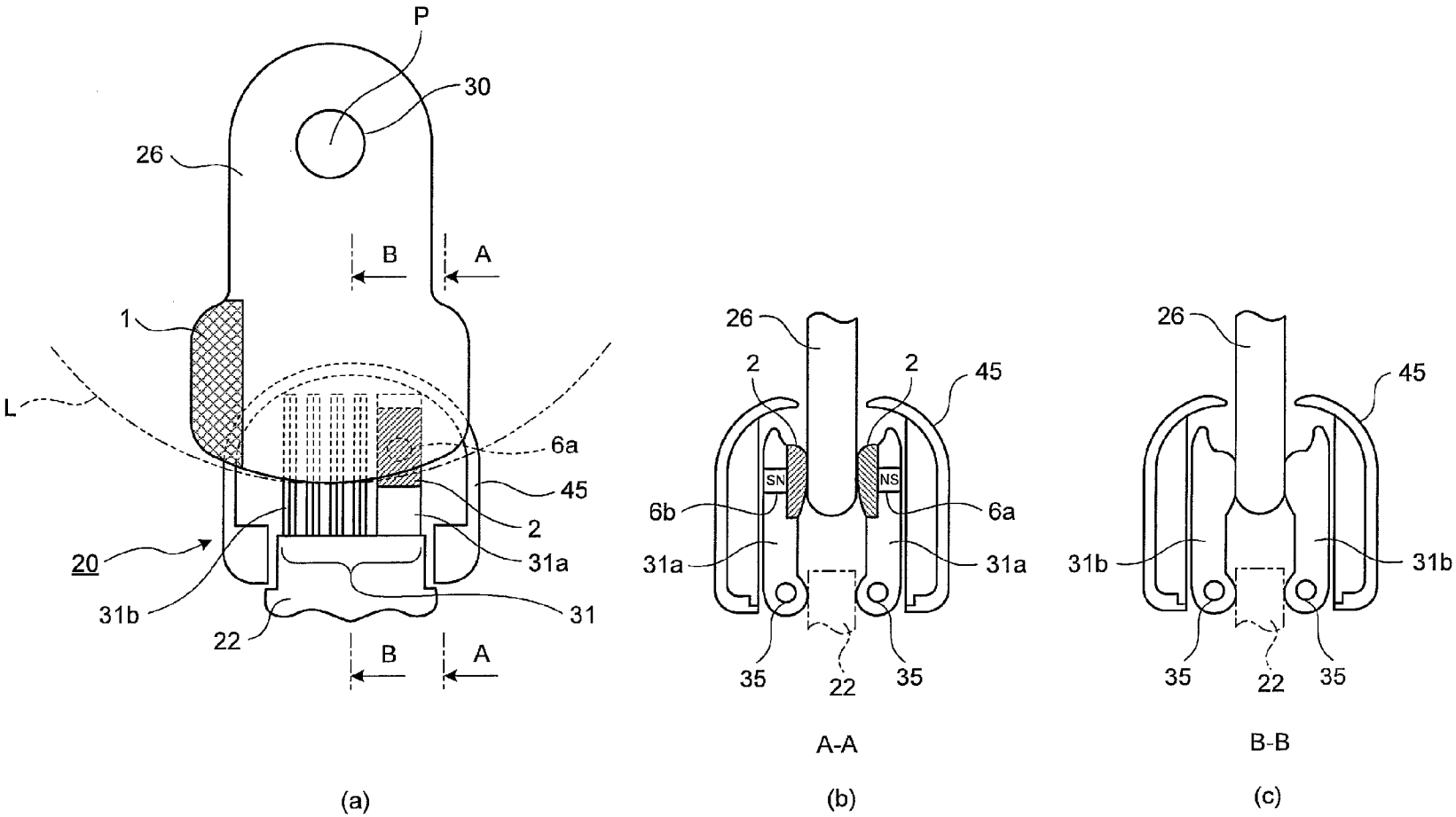
FIG. 1 are configuration diagrams of a current switch according to a first embodiment, where FIG. 1(*a*) depicts a cross-sectional configuration of the current switch taken along a rotation plane of a movable contact, and particularly depicts an arrangement configuration of the current switch in a closed (switch-on) state, FIG. 1(*b*) is a cross-sectional view taken along the line A-A in FIG. 1(*a*), and FIG. 1(*c*) is a cross-sectional view taken along the line B-B in FIG. 1(*a*).
Figure 2:
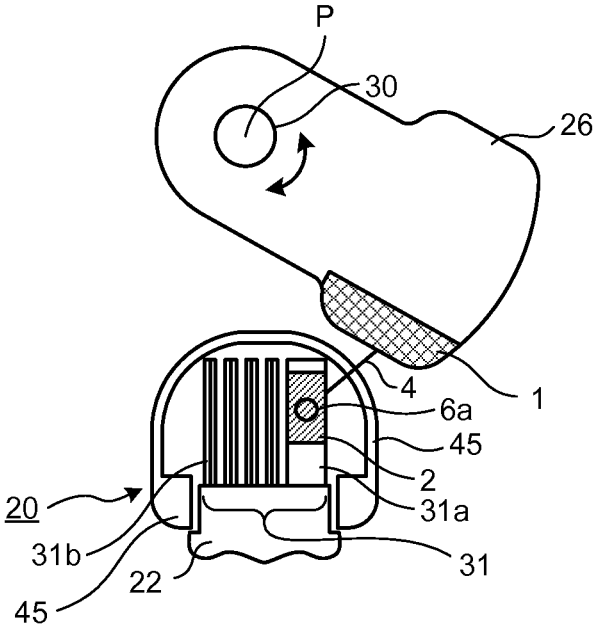
FIG. 2 is a configuration diagram of the current switch according to the first embodiment, and particularly depicts an arrangement configuration during an opening operation of the current switch.

FIG. 1 are configuration diagrams of a current switch according to the present embodiment, where FIG. 1(*a*) depicts a cross-sectional configuration of the current switch taken along a rotation plane of a movable contact, and particularly depicts an arrangement configuration of the current switch in a closed (switch-on) state, FIG. 1(*b*) is a cross-sectional view taken along the line A-A in FIG. 1(*a*), and FIG. 1(*c*) is a cross-sectional view taken along the line B-B in FIG. 1(*a*). FIG. 2 is a configuration diagram of the current switch according to the present embodiment, and particularly depicts an arrangement configuration during an opening operation of the current switch. FIG. 2 depicts a state where an arc 4 occurs between a movable arcing contact 1 and a fixed arcing contact 2.

The current switch is configured to include a movable contact 26 and a fixed contact 20 that comes into and out of contact with the movable contact 26. The current switch is arranged within a tank (not shown) filled with insulating gas such as sulfur hexafluoride gas.

The movable contact 26 is a blade-shaped contact that is pivotally supported by an insulating operation shaft 30. The movable contact 26 has a substantially elongated-plate shape that extends in a radial direction from a rotation center P, and rotates about the insulating operation shaft 30 as the rotation center such that the free end of the movable contact 26 draws a rotation locus L.

The movable arcing contact 1 that is formed from arc-resistance material such as copper-tungsten alloy is provided at a distal end of the movable contact 26. The movable arcing contact 1 is provided at the distal end of the movable contact 26 on a side of the fixed contact 20 in a reciprocating direction of the movable contact 26. That is, the movable arcing contact 1 is provided at the distal end of the movable contact 26 on the side on which the movable contact 26 lastly comes out of contact with the fixed contact 20 at the time of opening the current switch. The movable arcing contact 1 is provided so as to cover part of both surfaces of the movable contact 26, which are parallel to the rotation plane, and to cover part of the end surface between the surfaces. The rotation plane is a plane including the rotation locus L.

The free end of the movable contact 26 has a shape extending along the rotation locus L of the movable contact 26, for example. The shape as described above can relax the electric field of the free end when the movable contact 26 rotates in a voltage applied state, without increasing the rotating range.

The fixed contact 20 has a substantially U-shaped cross section, and is formed with an opening through which the movable contact 26 enters. This opening is arranged toward the direction of the insulating operation shaft 30. The fixed contact 20 includes a plurality of pairs of energizing contacts 31 that are paired with their distal ends facing toward the opening and that are arrayed in the direction of the rotation locus L, a support frame (not shown) that supports each base portion of the energizing contacts 31 in a tiltable manner, a pressurizing member (not shown) that urges the energizing contacts 31 in such a direction that their distal ends approach each other, and an outer frame 45 that serves as a shielding member that covers the periphery of the energizing contacts 31, the support frame, and the pressurizing member to shield them from the outside electric field.

The energizing contacts 31 are arranged so as to be opposed to each other with the rotation plane of the movable contact 26 being sandwiched therebetween, and are also provided in a plurality of pairs with predetermined intervals between the pairs in the direction of the rotation locus L of the movable contact 26. In the example shown in FIG. 1, the energizing contacts 31 adjacent to each other are spaced equally in the direction of the rotation locus L. Each of the energizing contacts 31 has a finger shape, for example. The energizing contacts 31 have the same length as each other, for example. The pairs of energizing contacts 31 constitute lines in the direction of the rotation locus L, and each of the lines is supported by a support bar 35 that is inserted through a through hole punched in each base portion of the energizing contacts 31. The energizing contacts 31 are connected to a connection conductor 22.

The outer frame 45 is manufactured from a casting that has a high degree of flexibility in shape and that effectively shields the electric field, for example. The outer frame 45 constitutes an outer shell of the fixed contact 20, and has a substantial box shape that covers the periphery of the energizing contacts 31, the support frame, and the pressurizing member. The outer frame 45 is formed with an opening, through which the blade-shaped movable contact 26 enters, at the position corresponding to the gap between the distal ends of the energizing contacts 31 that are paired and arranged to be opposed substantially parallel to each other.

The fixed arcing contact 2 is provided at each distal end of one of the pairs of energizing contacts 31, which is closest to the movable contact 26 in the reciprocating direction of the movable contact 26 (in the direction of the rotation locus L) in a state where the movable contact 26 is away from the fixed contact 20 (see FIG. 2). In FIGS. 1 and 2, the energizing contact 31 provided with the fixed arcing contact 2 is designated as an energizing contact 31*a*, and other energizing contacts 31 are designated as an energizing contact 31*b*. The fixed arcing contacts 2 are provided at the distal ends of the pair of energizing contacts 31*a* on the side on which the energizing contacts 31*a* are opposed to each other. The fixed arcing contacts 2 are formed from arc-resistance material such as cooper-tungsten alloy.

A pair of permanent magnets 6*a* and 6*b* is arranged within the pair of energizing contacts 31*a*. That is, the permanent magnet 6*a* is arranged within one of the pair of energizing contacts 31*a*, and the permanent magnet 6*b* is arranged within the other.

The permanent magnets 6*a* and 6*b* are both arranged such that both of their magnetizing directions are substantially perpendicular to the rotation plane of the movable contact 26, and are arranged on both sides of the movable contact 26 to be opposed to each other with its rotation plane being sandwiched therebetween. The permanent magnets 6*a* and 6*b* are, for example, cylindrical, respectively and are arranged on the same straight line.

As viewed from the rotation center P, the permanent magnets 6*a* and 6*b* are located within the range in which the fixed arcing contacts 2 are provided in a radial direction, and are arranged behind the fixed arcing contacts 2. That is, the permanent magnets 6*a* and 6*b* are arranged to be opposed to each other with the fixed arcing contacts 2 being sandwiched therebetween in the direction perpendicular to the rotation plane. Therefore, the permanent magnets 6*a* and 6*b* are arranged adjacent to the point at which the movable arcing contact 1 comes into and out of contact with the fixed arcing contacts 2.

As viewed from the rotation center P, the permanent magnets 6*a* and 6*b* are arranged on the outer side in the radial direction relative to the point at which the movable arcing contact 1 comes into and out of contact with the fixed arcing contacts 2, for example. The permanent magnets 6*a* and 6*b* can be arranged on the inner side in the radial direction relative to the above point, or can be arranged substantially at the same position in the radial direction as the above point.

The permanent magnets 6*a* and 6*b* are arranged such that different polarities are opposed to each other. That is, the N pole of the permanent magnet 6*a* and the S pole of the permanent magnet 6*b* are opposed to each other with the rotation plane being sandwiched therebetween, for example. Therefore, at the position of the occurrence of the arc 4, the direction of magnetic-flux density is substantially parallel to the magnetizing directions of the permanent magnets 6*a* and 6*b*, and the magnetic-flux density is substantially perpendicular to the arc 4 that is substantially parallel to the reciprocating direction of the movable contact 26.

The width of the energizing contacts 31*a* is larger than that of the energizing contacts 31*b*. With this structure, the arrangement of the permanent magnets 6*a* and 6*b* is facilitated, and also the width of the fixed arcing contacts 2, where the arc 4 occurs, is larger. Therefore, this structure has an effect of preventing the arc 4 from moving to the energizing contacts 31*b* adjacent to the fixed arcing contacts 2, and preventing dissolution loss of the energizing contacts 31*b*.

An operation according to the present embodiment is explained. An opening operation is explained below, for example. However, a switch-on operation is also the same as the opening operation. In the closed state (FIG. 1), the movable contact 26 comes into contact with the energizing contacts 31. However, at the time of opening the current switch, the movable contact 26 and the energizing contacts 31 first separate from each other, and then the movable arcing contact 1 and the fixed arcing contacts 2 separate from each other. Therefore, the arc 4 occurs between the movable arcing contact 1 and the fixed arcing contacts 2 (FIG. 2). However, the permanent magnets 6*a* and 6*b* are arranged within the energizing contacts 31*a*, respectively, and the magnetic-flux density between the permanent magnets 6*a* and 6*b* is generated in the direction substantially perpendicular to the arc 4. Accordingly, at the same time as the occurrence of the arc 4, the arc 4 is driven upon receiving the Lorentz force in the direction perpendicular to both the magnetic-flux density direction and the extending direction of the arc 4 (the reciprocating direction), and is effectively cooled and extinguished by arc-extinguishing insulating gas.

As explained above, according to the present embodiment, the arc 4 can be driven and quickly extinguished within a gas space by the permanent magnets 6*a* and 6*b*, thereby improving the current switching performance.

Particularly, the permanent magnets 6*a* and 6*b* are arranged within the energizing contacts 31*a*, respectively, and are therefore arranged immediately adjacent to the point at which the movable arcing contact 1 comes into and out of contact with the fixed arcing contacts 2. Accordingly, the arc 4 is driven very effectively by the magnetic-flux density generated by the permanent magnets 6*a* and 6*b*, thereby improving the current switching performance.

Further, according to the present embodiment, because the permanent magnets 6*a* and 6*b* are arranged inside the fixed contact 20, it is also possible to reduce the dimensions of the entire current switch as compared to the configuration in which the permanent magnets 6*a* and 6*b* are provided outside the fixed contact 20.

Furthermore, according to the present embodiment, the pair of permanent magnets 6*a* and 6*b* is arranged adjacent to the arc 4 such that different polarities of the permanent magnets 6*a* and 6*b* are opposed to each other with the rotation plane being sandwiched therebetween. Therefore, the magnetic-flux density that is perpendicular to the extending direction of the arc 4 (the reciprocating direction) can be increased, and accordingly extinction of the arc 4 is more promoted.

The magnetizing directions of the permanent magnets 6*a* and 6*b* can also be the same as each other, for example. That is, it is also possible to arrange the N pole of the permanent magnet 6*a* and the N pole of the permanent magnet 6*b* to be opposed to each other with the rotation plane being sandwiched therebetween, for example. In this case, it is preferable that, as viewed from the rotation center P, the permanent magnets 6*a* and 6*b* are arranged, for example, on the outer side in the radial direction relative to the point at which the movable arcing contact 1 comes into and out of contact with the fixed arcing contacts 2. In this case, at the position of the occurrence of the arc 4, the direction of magnetic-flux density is substantially perpendicular to the magnetizing directions of the permanent magnets 6*a* and 6*b*, and the magnetic-flux density is substantially perpendicular to the arc 4 that is substantially parallel to the reciprocating direction of the movable contact 26.

It is also possible to arrange either the permanent magnet 6*a* or 6*b* on one side of the rotation plane, for example.

Second Embodiment

Figure 3:
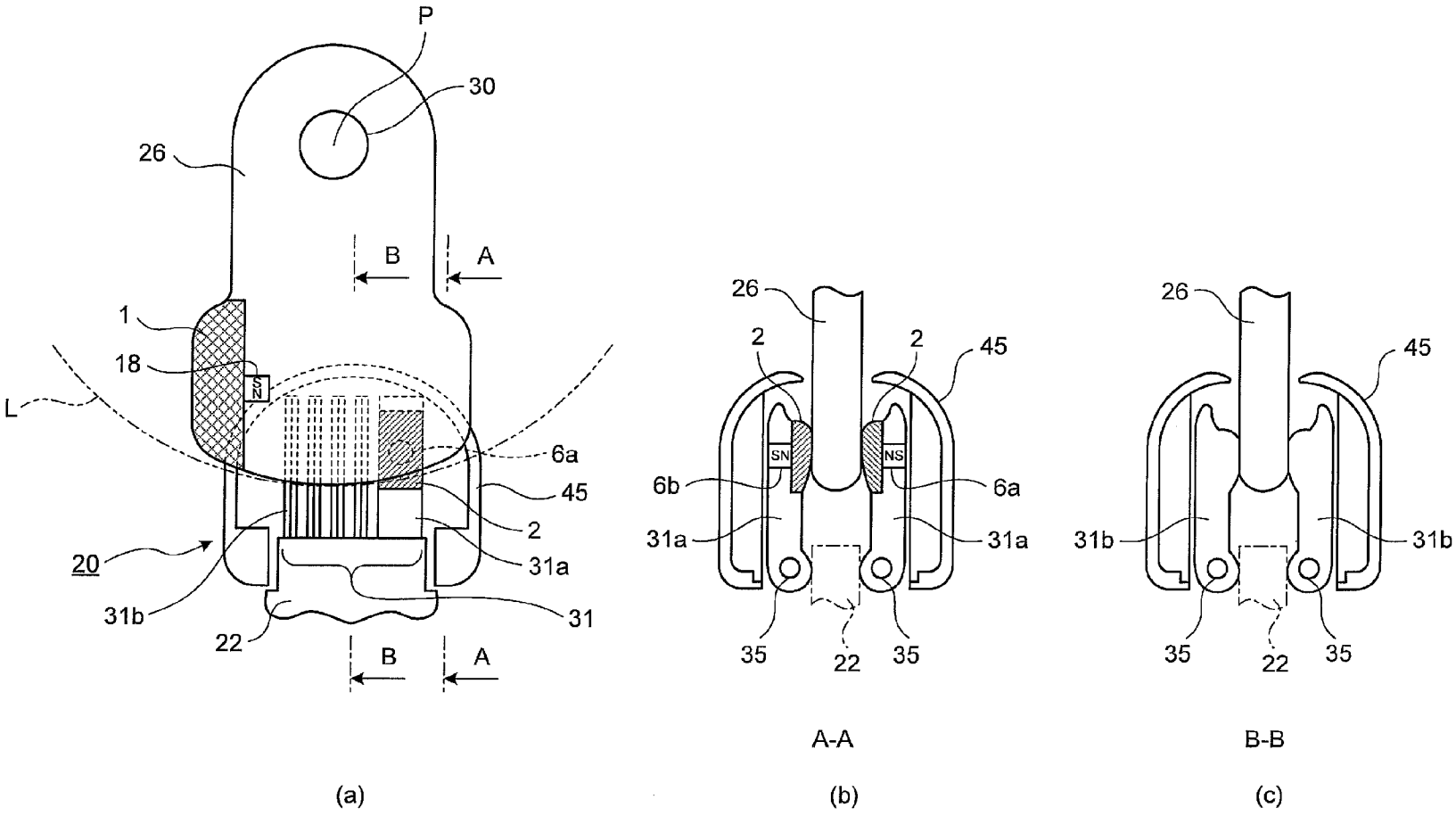
FIG. 3 are configuration diagrams of a current switch according to a second embodiment, where FIG. 3(*a*) depicts a cross-sectional configuration of the current switch taken along a rotation plane of a movable contact, and particularly depicts an arrangement configuration of the current switch in a closed (switch-on) state, FIG. 3(*b*) is a cross-sectional view taken along the line A-A in FIG. 3(*a*), and FIG. 3(*c*) is a cross-sectional view taken along the line B-B in FIG. 3(*a*).
Figure 4:
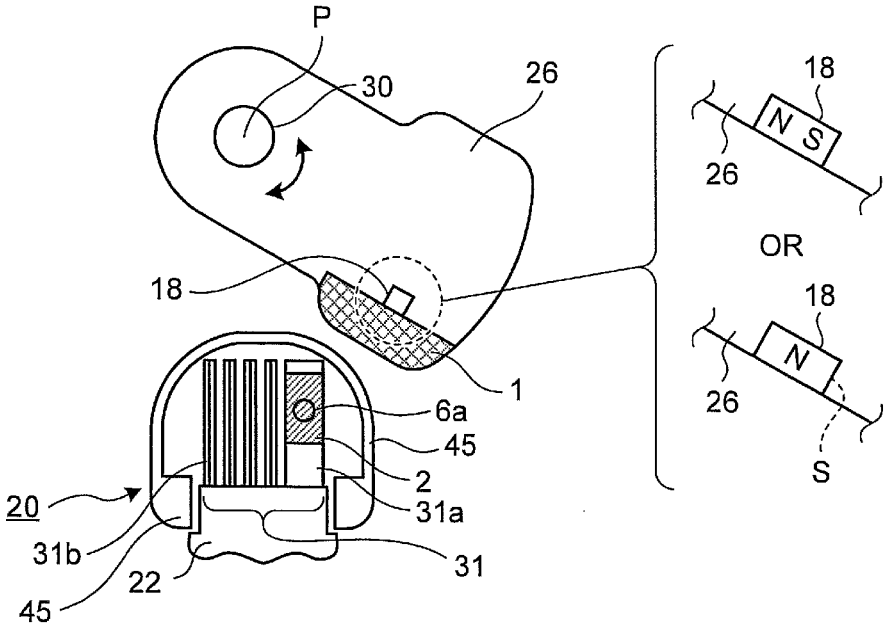
FIG. 4 is a configuration diagram of the current switch according to the second embodiment, and particularly depicts an arrangement configuration during an opening operation of the current switch.

FIG. 3 are configuration diagrams of a current switch according to the present embodiment, where FIG. 3(*a*) depicts a cross-sectional configuration of the current switch taken along a rotation plane of a movable contact, and particularly depicts an arrangement configuration of the current switch in a closed (switch-on) state, FIG. 3(*b*) is a cross-sectional view taken along the line A-A in FIG. 3(*a*), and FIG. 3(*c*) is a cross-sectional view taken along the line B-B in FIG. 3(*a*). FIG. 4 is a configuration diagram of the current switch according to the present embodiment, and particularly depicts an arrangement configuration during an opening operation of the current switch. In FIG. 3 and FIG. 4, constituent elements identical to those of FIG. 1 and FIG. 2 are denoted by like reference signs and detailed explanations thereof will be omitted. In the following explanations, points different from those of FIG. 1 and FIG. 2 are mainly explained.

As shown in FIGS. 3 and 4, in the present embodiment, a permanent magnet 18 is also arranged inside the movable contact 26. The permanent magnet 18 is arranged adjacent to the movable arcing contact 1, and is therefore arranged adjacent to the point at which the movable arcing contact 1 comes into and out of contact with the fixed arcing contacts 2.

The permanent magnet 18 is arranged with its magnetizing direction substantially parallel to the extending direction of the movable contact 26 (the radial direction), for example. The permanent magnet 18 is cylindrical, for example. At the position of the occurrence of the arc 4, the direction of magnetic-flux density of the permanent magnet 18 is substantially perpendicular to the arc 4 that is substantially parallel to the reciprocating direction of the movable contact 26.

The permanent magnet 18 can also be arranged such that its magnetizing direction is substantially perpendicular to the rotation plane of the movable contact 26, for example. In this case, at the position of the occurrence of the arc 4, the direction of magnetic-flux density can also be substantially perpendicular to the arc 4 that is substantially parallel to the reciprocating direction of the movable contact 26.

An operation according to the present embodiment is explained. An opening operation is explained below, for example. However, a switch-on operation is also the same as the opening operation. In the closed state (FIG. 3), the movable contact 26 comes into contact with the energizing contacts 31. However, at the time of opening the current switch, the movable contact 26 and the energizing contacts 31 first separate from each other, and then the movable arcing contact 1 and the fixed arcing contacts 2 separate from each other. Therefore, the arc 4 occurs between the movable arcing contact 1 and the fixed arcing contacts 2 (FIG. 4). However, the permanent magnets 6*a* and 6*b* are arranged within the energizing contacts 31*a* as explained in the first embodiment, and therefore the magnetic-flux density of the permanent magnets 6*a* and 6*b* is generated in the direction substantially perpendicular to the arc 4 at the position of the occurrence of the arc 4. In addition, the magnetic-flux density of the permanent magnet 18 arranged within the movable contact 26 is generated in the direction substantially perpendicular to the arc 4. Accordingly, at the same time as the occurrence of the arc 4, the arc 4 is driven upon receiving the Lorentz force by the magnetic-flux density generated both by the permanent magnets 6*a* and 6*b* and by the permanent magnet 18, and is effectively cooled and extinguished by arc-extinguishing insulating gas.

According to the present embodiment, because the permanent magnet 18 is provided within the movable contact 26 in addition to the permanent magnets 6*a* and 6*b* within the energizing contacts 31*a*, the current switching performance is further improved as compared to that of the first embodiment. Other configurations, operations, and effects of the present embodiment are identical to those of the first embodiment.

Third Embodiment

Figure 5:
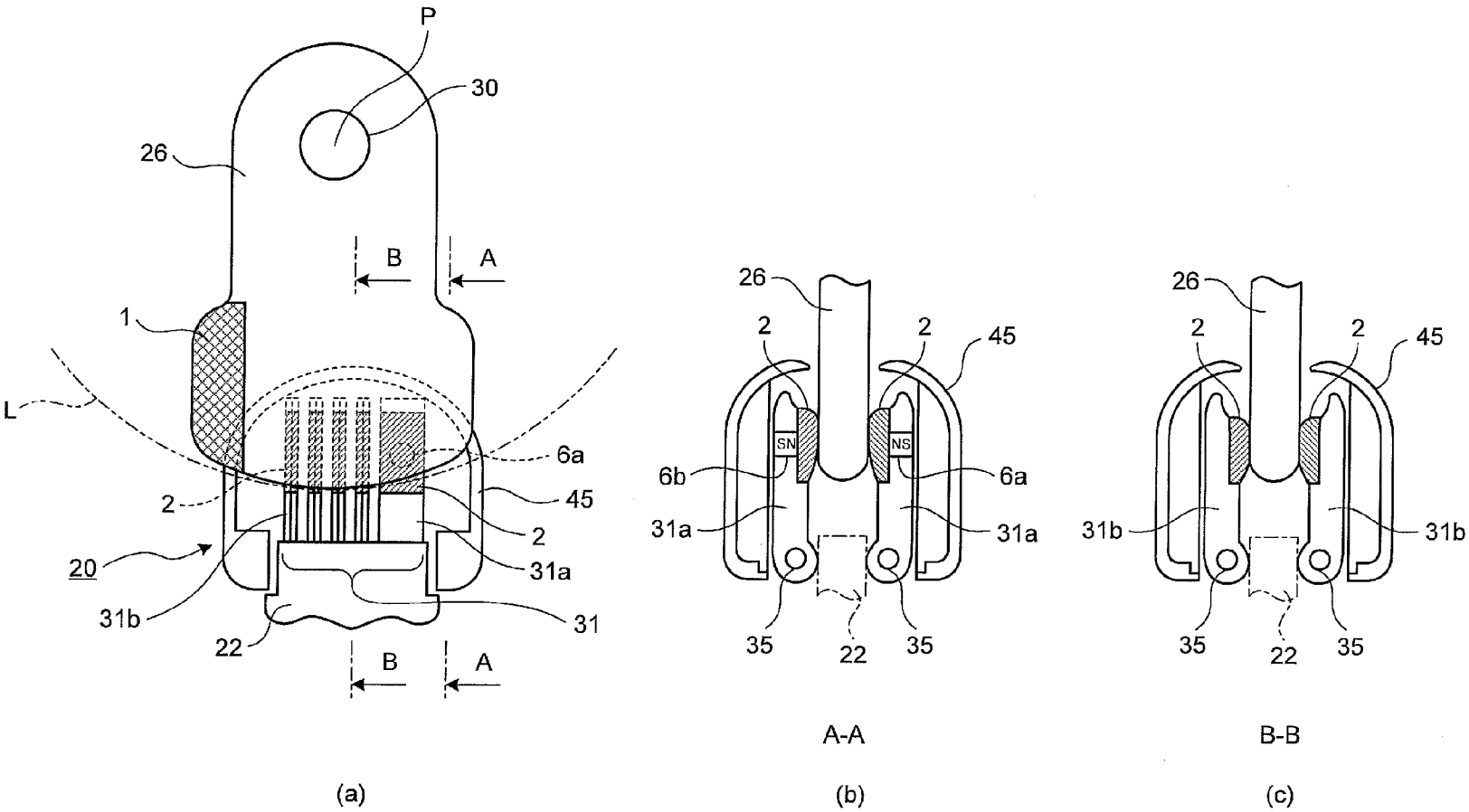
FIG. 5 are configuration diagrams of a current switch according to a third embodiment, where FIG. 5(*a*) depicts a cross-sectional configuration of the current switch taken along a rotation plane of a movable contact, and particularly depicts an arrangement configuration of the current switch in a closed (switch-on) state, FIG. 5(*b*) is a cross-sectional view taken along the line A-A in FIG. 5(*a*), and FIG. 5(*c*) is a cross-sectional view taken along the line B-B in FIG. 5(*a*).
Figure 6:
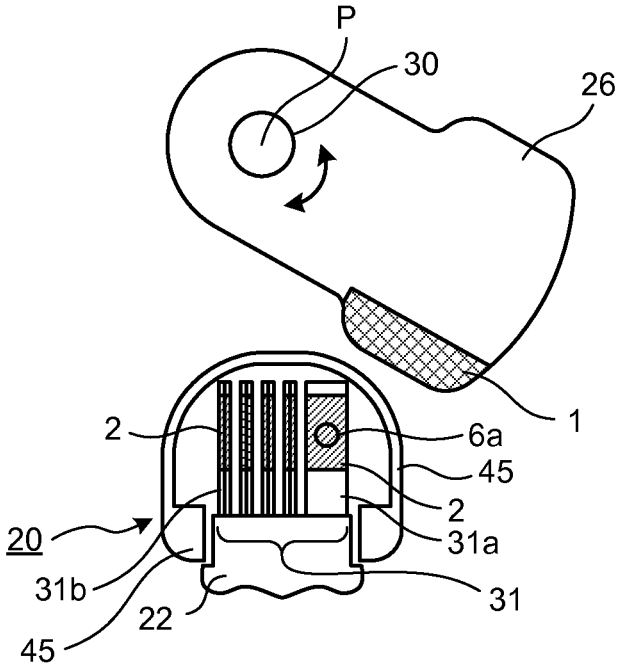
FIG. 6 is a configuration diagram of the current switch according to the third embodiment, and particularly depicts an arrangement configuration during an opening operation of the current switch.

FIG. 5 are configuration diagrams of a current switch according to the present embodiment, where FIG. 5(*a*) depicts a cross-sectional configuration of the current switch taken along a rotation plane of a movable contact, and particularly depicts an arrangement configuration of the current switch in a closed (switch-on) state, FIG. 5(*b*) is a cross-sectional view taken along the line A-A in FIG. 5(*a*), and FIG. 5(*c*) is a cross-sectional view taken along the line B-B in FIG. 5(*a*). FIG. 6 is a configuration diagram of the current switch according to the present embodiment, and particularly depicts an arrangement configuration during an opening operation of the current switch. In FIG. 5 and FIG. 6, constituent elements identical to those of FIG. 1 and FIG. 2 are denoted by like reference signs and detailed explanations thereof will be omitted. In the following explanations, points different from those of FIG. 1 and FIG. 2 are mainly explained.

As shown in FIGS. 5 and 6, in the present embodiment, the fixed arcing contacts 2 are provided not only on the energizing contacts 31*a* but also on the energizing contacts 31*b*. That is, the fixed arcing contacts 2 are provided on all the energizing contacts 31. The arrangement location of each of the fixed arcing contacts 2 on the energizing contacts 31*b* is the same as in the case of the energizing contacts 31*a*.

With the configuration as described above, even when the arc 4 having been driven by the permanent magnets 6*a* and 6*b* oscillates and moves from the fixed arcing contacts 2 on the energizing contacts 31*a* to the energizing contacts 31*b*, the fixed arcing contacts 2 are also provided on the energizing contacts 31*b*, and it is therefore possible to prevent the energizing contacts 31*b* from being worn down. Other configurations, operations, and effects of the present embodiment are identical to those of the first embodiment. The present embodiment can be also combined with the second embodiment.

Fourth Embodiment

Figure 7:
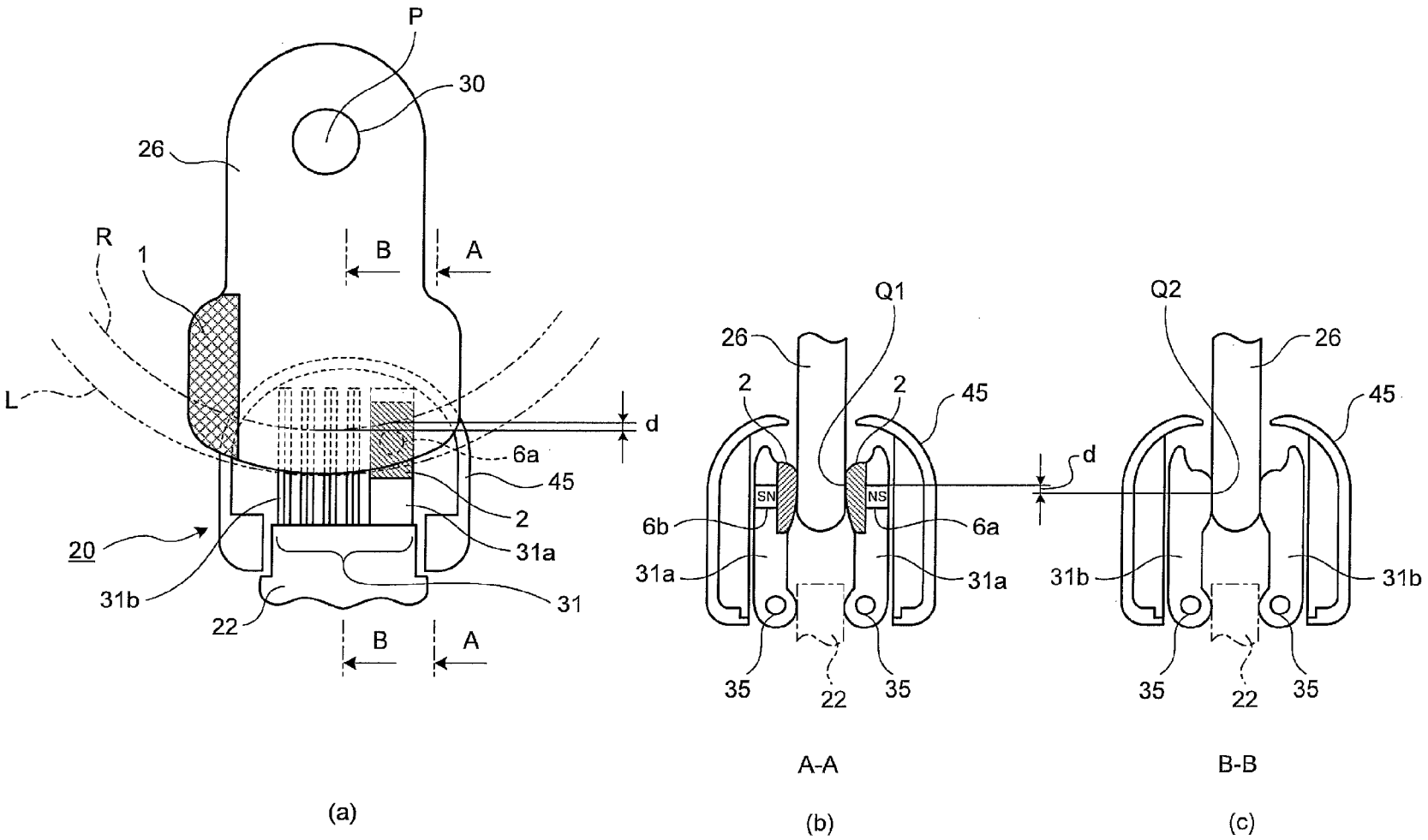
FIG. 7 are configuration diagrams of a current switch according to a fourth embodiment, where FIG. 7(*a*) depicts a cross-sectional configuration of the current switch taken along a rotation plane of a movable contact, and particularly depicts an arrangement configuration of the current switch in a closed (switch-on) state, FIG. 7(*b*) is a cross-sectional view taken along the line A-A in FIG. 7(*a*), and FIG. 7(*c*) is a cross-sectional view taken along the line B-B in FIG. 7(*a*).
Figure 8:
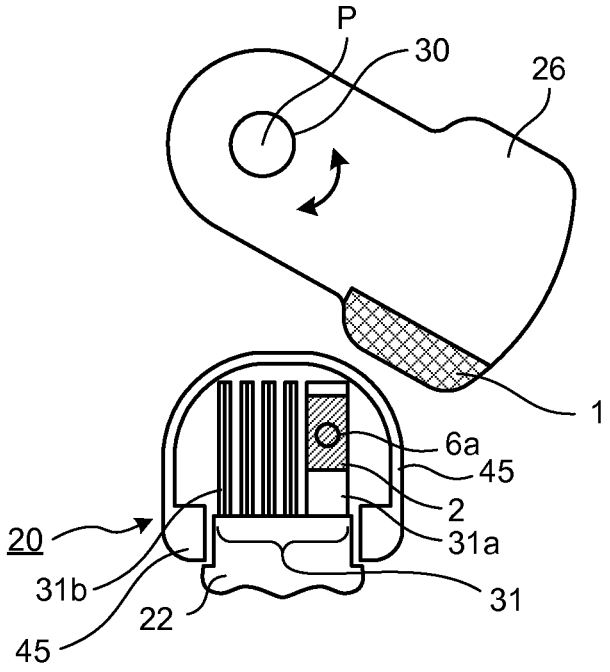
FIG. 8 is a configuration diagram of the current switch according to the fourth embodiment, and particularly depicts an arrangement configuration during an opening operation of the current switch.

FIG. 7 are configuration diagrams of a current switch according to the present embodiment, where FIG. 7(*a*) depicts a cross-sectional configuration of the current switch taken along a rotation plane of a movable contact, and particularly depicts an arrangement configuration of the current switch in a closed (switch-on) state, FIG. 7(*b*) is a cross-sectional view taken along the line A-A in FIG. 7(*a*), and FIG. 7(*c*) is a cross-sectional view taken along the line B-B in FIG. 7(*a*). FIG. 8 is a configuration diagram of the current switch according to the present embodiment, and particularly depicts an arrangement configuration during an opening operation of the current switch. In FIG. 7 and FIG. 8, constituent elements identical to those of FIG. 1 and FIG. 2 are denoted by like reference signs and detailed explanations thereof will be omitted. In the following explanations, points different from those of FIG. 1 and FIG. 2 are mainly explained.

As shown in FIGS. 7 and 8, in the present embodiment, the points at which the movable contact 26 comes into and out of contact with the energizing contacts 31 are arranged on one circular arc relative to the rotation center P. That is, the points at which the movable contact 26 comes into and out of contact with the energizing contacts 31*b* and the point at which the movable contact 26 comes into and out of contact with the energizing contacts 31*a* (the fixed arcing contacts 2) are arranged on a circular arc of a radius R about the rotation center P. In the first embodiment, a group of the points at which the movable contact 26 comes into and out of contact with the energizing contacts 31 is arranged straightly in the array direction of pairs of energizing contacts. In FIG. 7, the distance in the radial direction between the point at which the energizing contacts 31*a* (the fixed arcing contacts 2) come into and out of contact with the movable contact 26, and the point at which the energizing contacts 31*b*, located at the center in the array direction of pairs of energizing contacts, come into and out of contact with the movable contact 26, is designated as "d".

According to the configuration as described above, the group of the points at which the movable contact 26 comes into and out of contact with the energizing contacts 31 is arranged not on the same straight line but on one circular arc about the rotation center P, and the distance between the point at which the energizing contacts 31*b* come into and out of contact with the movable contact 26, and the point at which the fixed arcing contacts 2 come into and out of contact with the movable contact 26, is long. Therefore, at the time of the occurrence of the arc 4, it is possible to prevent the arc 4 from moving from the fixed arcing contacts 2 to the energizing contacts 31*b* and to prevent the vicinity of the point at which the energizing contacts 31*b* come into and out of contact with the movable contact 26 from being worn down.

In the present embodiment, the energizing contacts 31*a* and 31*b* have the same length as each other, and the positions of the above points vary from each other, so as to suppress movement of the arc 4 from the fixed arcing contacts 2 to the energizing contacts 31*b*. Therefore, the lengths themselves of the energizing contacts 31*a* and 31*b* do not need to be different from each other.

Other configurations, operations, and effects of the present embodiment are identical to those of the first embodiment. The present embodiment can be also combined with the second and third embodiments.

Fifth Embodiment

Figure 9:
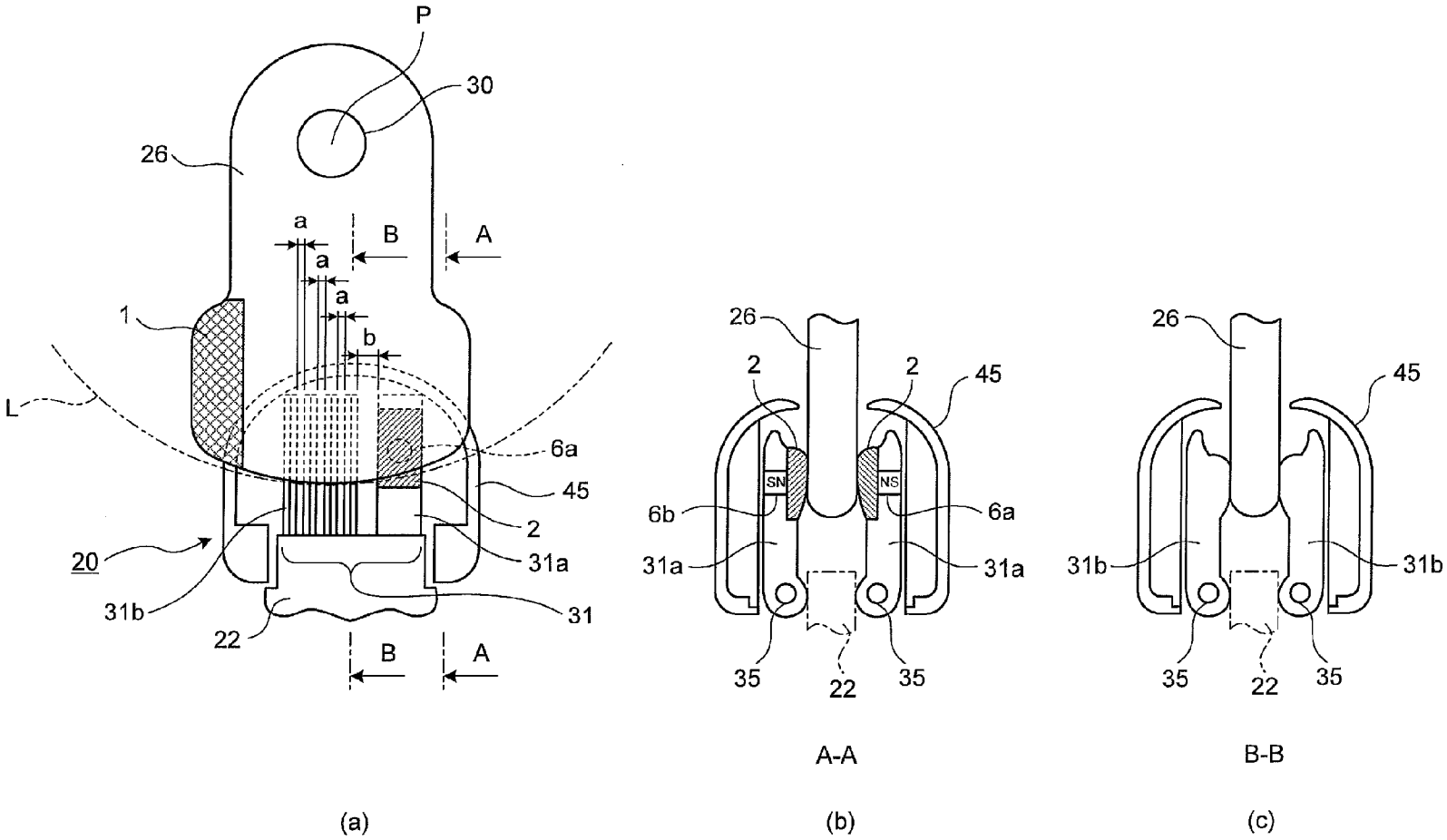
FIG. 9 are configuration diagrams of a current switch according to a fifth embodiment, where FIG. 9(*a*) depicts a cross-sectional configuration of the current switch taken along a rotation plane of a movable contact, and particularly depicts an arrangement configuration of the current switch in a closed (switch-on) state, FIG. 9(*b*) is a cross-sectional view taken along the line A-A in FIG. 9(*a*), and FIG. 9(*c*) is a cross-sectional view taken along the line B-B in FIG. 9(*a*).
Figure 10:
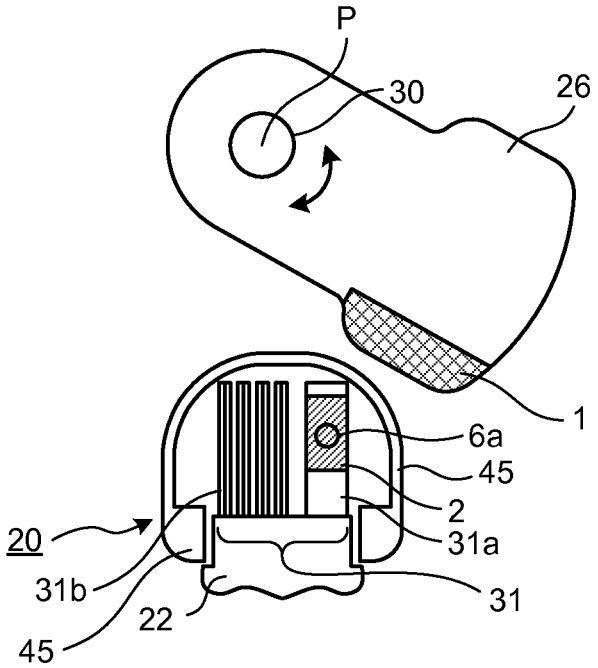
FIG. 10 is a configuration diagram of the current switch according to the fifth embodiment, and particularly depicts an arrangement configuration during an opening operation of the current switch.

FIG. 9 are configuration diagrams of a current switch according to the present embodiment, where FIG. 9(*a*) depicts a cross-sectional configuration of the current switch taken along a rotation plane of a movable contact, and particularly depicts an arrangement configuration of the current switch in a closed (switch-on) state, FIG. 9(*b*) is a cross-sectional view taken along the line A-A in FIG. 9(*a*), and FIG. 9(*c*) is a cross-sectional view taken along the line B-B in FIG. 9(*a*). FIG. 10 is a configuration diagram of the current switch according to the present embodiment, and particularly depicts an arrangement configuration during an opening operation of the current switch. In FIG. 9 and FIG. 10, constituent elements identical to those of FIG. 1 and FIG. 2 are denoted by like reference signs and detailed explanations thereof will be omitted. In the following explanations, points different from those of FIG. 1 and FIG. 2 are mainly explained.

As shown in FIGS. 9 and 10, in the present embodiment, three or more pairs of the energizing contacts 31 are provided, and an interval "b" between the energizing contacts 31*a* and the energizing contacts 31*b* adjacent to the energizing contacts 31*a* is larger than an interval "a" between the energizing contacts 31*b* adjacent to each other.

According to the configuration as described above, the permanent magnets 6*a* and 6*b* can prevent the arc 4 from oscillating and moving from the fixed arcing contacts 2 to the energizing contacts 31*b* adjacent to the fixed arcing contacts 2 at the time of the occurrence of the arc 4, and it is possible to prevent the energizing contacts 31*b* from being worn down.

Other configurations, operations, and effects of the present embodiment are identical to those of the first embodiment. The present embodiment can be also combined with the second to fourth embodiments.

INDUSTRIAL APPLICABILITY

As described above, the present invention is useful as a current switch of, for example, a gas insulated switchgear.

REFERENCE SIGNS LIST

1 Movable arcing contact
2 Fixed arcing contact
6*a*, 6*b*, 18 Permanent magnet
4 Arc
20 Fixed contact
22 Connection conductor
26 Movable contact
30 Insulating operation shaft (rotating shaft)
31, 31*a*, 31*b* Energizing contact
35 Support bar
45 Outer frame

The invention claimed is:

1. A current switch comprising:

a blade-shaped movable contact that extends in a radial direction from a rotation center, and that reciprocates such that a free end of the movable contact draws a rotation locus;

a fixed contact that comes into and out of contact with the movable contact, and that includes a plurality of pairs of energizing contacts that are opposed to each other on both sides of the movable contact with a rotation plane of the movable contact being sandwiched therebetween to be paired, and are arrayed in a direction of the rotation locus;

a movable arcing contact that is provided on the movable contact;

fixed arcing contacts that are provided on a pair of energizing contacts among the pairs of energizing contacts, the pair of energizing contacts being arranged closest to the movable contact in a state where the movable contact is away from the fixed contact; and a pair of permanent magnets that are arranged within the pair of energizing contacts, on which the fixed arcing contacts are provided, that are opposed to each other with the rotation plane being sandwiched therebetween to be paired, and that are arranged such that both magnetizing directions of the permanent magnets are perpendicular to the rotation plane, wherein the fixed arcing contacts are provided at respective distal ends of the pair of energizing contacts on a side on which the energizing contacts are opposed to each other, one of the pair of permanent magnets is arranged behind a fixed arcing contact within an energizing contact that includes therein the corresponding permanent magnet, and another one of the pair of permanent magnets is arranged behind a fixed arcing contact within an energizing contact that includes therein the corresponding permanent magnet.

2. The current switch according to claim 1, wherein points at which the pairs of energizing contacts come into and out of contact with the movable contact are arranged on one circular arc about the rotation center.

3. The current switch according to claim 1, further comprising another permanent magnet that is arranged inside the movable contact.

4. The current switch according to claim 3, wherein a magnetizing direction of the another permanent magnet is parallel to an extending direction of the movable contact.

5. The current switch according to claim 3, wherein a magnetizing direction of the another permanent magnet is perpendicular to the rotation plane of the movable contact.

6. The current switch according to claim 1, wherein a width of an energizing contact that includes therein the permanent magnet is larger than that of other energizing contacts.

7. The current switch according to claim 1, wherein, as viewed from the rotation center, the pair of permanent magnets is arranged on an outer side in the radial direction relative to a point at which the movable arcing contact comes into and out of contact with the fixed arcing contacts.

8. The current switch according to claim 1, wherein magnetizing directions of the pair of permanent magnets are opposite to each other.

9. The current switch according to claim 1, wherein magnetizing directions of the pair of permanent magnets are same as each other.

10. A current switch comprising:

a blade-shaped movable contact that extends in a radial direction from a rotation center, and that reciprocates such that a free end of the movable contact draws a rotation locus;

a fixed contact that comes into and out of contact with the movable contact, and that includes a plurality of pairs of energizing contacts that are opposed to each other on both sides of the movable contact with a rotation plane of the movable contact being sandwiched therebetween to be paired, and are arrayed in a direction of the rotation locus;

a movable arcing contact that is provided on the movable contact;

fixed arcing contacts that are provided on a pair of energizing contacts among the pairs of energizing contacts, the pair of energizing contacts being arranged closest to the movable contact in a state where the movable contact is away from the fixed contact; and a pair of permanent magnets that are arranged within the pair of energizing contacts, on which the fixed arcing contacts are provided, that are opposed to each other with the rotation plane being sandwiched therebetween to be paired, and that are arranged such that both magnetizing directions of the permanent magnets are perpendicular to the rotation plane, wherein a fixed arcing contact is provided also on all of the pairs of energizing contacts in addition to the pair of energizing contacts that include therein the permanent magnets.

11. The current switch according to claim 10, wherein points at which the pairs of energizing contacts come into and out of contact with the movable contact are arranged on one circular arc about the rotation center.

12. The current switch according to claim 10, further comprising another permanent magnet that is arranged inside the movable contact.

13. The current switch according to claim 12, wherein a magnetizing direction of the another permanent magnet is parallel to an extending direction of the movable contact.

14. The current switch according to claim 12, wherein a magnetizing direction of the another permanent magnet is perpendicular to the rotation plane of the movable contact.

15. The current switch according to claim 10, wherein a width of an energizing contact that includes therein the permanent magnet is larger than that of other energizing contacts.

16. The current switch according to claim 10, wherein, as viewed from the rotation center, the pair of permanent magnets is arranged on an outer side in the radial direction relative to a point at which the movable arcing contact comes into and out of contact with the fixed arcing contacts.

17. The current switch according to claim 10, wherein magnetizing directions of the pair of permanent magnets are opposite to each other.

18. The current switch according to claim 10, wherein magnetizing directions of the pair of permanent magnets are same as each other.

19. A current switch comprising:

a blade-shaped movable contact that extends in a radial direction from a rotation center, and that reciprocates such that a free end of the movable contact draws a rotation locus;

a fixed contact that comes into and out of contact with the movable contact, and that includes a plurality of pairs of energizing contacts that are opposed to each other on both sides of the movable contact with a rotation plane of the movable contact being sandwiched therebetween to be paired, and are arrayed in a direction of the rotation locus;

a movable arcing contact that is provided on the movable contact;

fixed arcing contacts that are provided on a pair of energizing contacts among the pairs of energizing contacts, the pair of energizing contacts being arranged closest to the movable contact in a state where the movable contact is away from the fixed contact; and a pair of permanent magnets that are arranged within the pair of energizing contacts, on which the fixed arcing contacts are provided, that are opposed to each other with the rotation plane being sandwiched therebetween to be paired, and that are arranged such that both magnetizing directions of the permanent magnets are perpendicular to the rotation plane, wherein number of the pairs of energizing contacts provided is three or more, and an interval between the pair of energizing contacts that include therein the permanent magnets and its adjacent pair of energizing contacts is larger than an interval between adjacent pairs of energizing contacts other than the pair of energizing contacts that include therein the permanent magnets.

* * * * *